US012624486B2

(12) United States Patent
Xu et al.

(10) Patent No.: US 12,624,486 B2
(45) Date of Patent: May 12, 2026

(54) WASHING MACHINE CONTROL METHOD FOR DISPENSING LIQUID, AND WASHING MACHINE

(71) Applicants: HAIER IOC ECOSYSTEM TECHNOLOGIES (SHANGHAI) CO., LTD., Shanghai (CN); HAIER SMART HOME CO., LTD., Qingdao (CN)

(72) Inventors: Sheng Xu, Qingdao (CN); Dongsong Sun, Qingdao (CN); Yanfen Lv, Qingdao (CN); Tao Zhang, Qingdao (CN); Chuanrong Ma, Qingdao (CN)

(73) Assignees: HAIER IOC ECOSYSTEM TECHNOLOGIES (SHANGHAI) CO.. LTD., Shanghai (CN); HAIER SMART HOME CO., LTD., Qingdao (CN)

( * ) Notice: Subject to any disclaimer, the term of this patent is extended or adjusted under 35 U.S.C. 154(b) by 180 days.

(21) Appl. No.: 18/717,889

(22) PCT Filed: Nov. 18, 2022

(86) PCT No.: PCT/CN2022/132807
§ 371 (c)(1),
(2) Date: Jun. 7, 2024

(87) PCT Pub. No.: WO2023/103745
PCT Pub. Date: Jun. 15, 2023

(65) Prior Publication Data

US 2025/0027249 A1 Jan. 23, 2025

(30) Foreign Application Priority Data

Dec. 10, 2021 (CN) ..... 202111505328.5

(51) Int. Cl.
*D06F 33/37* (2020.01)
*D06F 33/43* (2020.01)
(Continued)

(52) U.S. Cl.
CPC ..... *D06F 33/37* (2020.02); *D06F 33/43* (2020.02); *D06F 39/022* (2013.01);
(Continued)

(58) Field of Classification Search
CPC ..... D06F 33/37; D06F 33/43; D06F 39/022; D06F 2103/44; D06F 2105/02;
(Continued)

(56) References Cited

U.S. PATENT DOCUMENTS 3,504,703 A * 4/1970 Bozoyan ..... F15B 13/04 137/625.23
4,580,600 A * 4/1986 Mazzei ..... D06F 39/08 137/625.46
(Continued)

FOREIGN PATENT DOCUMENTS

CN 103290657 A 9/2013
CN 203654014 U 6/2014
(Continued)

OTHER PUBLICATIONS

International Search Report (PCT/ISA/210) with translation and Written Opinion (PCT/ISA/237) mailed on Feb. 17, 2023, by the China National Intellectual Property Administration for International Application No. PCT/CN2022/132807. (9 pages).

*Primary Examiner* — Donnell A Long
(74) *Attorney, Agent, or Firm* — Buchanan Ingersoll & Rooney PC

(57) ABSTRACT

A washing machine control method includes receiving an instruction for dispensing laundry treatment agent; controlling a switching valve to be in a preset neutral position
(Continued)

where a valve core is not communicated with liquid inlets of a valve body; controlling the valve core of the switching valve to rotate to be communicated with a liquid inlet corresponding to a laundry treatment agent for dispensing; controlling the switching valve to rotate to be in the preset neutral position; determining whether to dispense a laundry treatment agent again; if not, controlling the switching valve to feed water for flushing. After receiving an instruction for dispensing a laundry treatment agent, the switching valve starts to run from a preset neutral position. After a laundry treatment agent is dispensed, the switching valve is again controlled to return to the preset neutral position, and then determining to receive a dispensing instruction.

9 Claims, 4 Drawing Sheets

(51) Int. Cl.

| | |
|---|---|
| ***D06F 39/02*** | (2006.01) |
| *D06F 103/44* | (2020.01) |
| *D06F 105/02* | (2020.01) |
| *D06F 105/42* | (2020.01) |
| *D06F 105/46* | (2020.01) |

(52) U.S. Cl.
CPC ..... *D06F 2103/44* (2020.02); *D06F 2105/02* (2020.02); *D06F 2105/42* (2020.02); *D06F 2105/46* (2020.02)

(58) Field of Classification Search
CPC .. D06F 2105/42; D06F 2105/46; D06F 33/34; D06F 39/02; D06F 39/028; D06F 39/08; D06F 39/088; Y02B 40/00
See application file for complete search history.

(56) References Cited

U.S. PATENT DOCUMENTS

| | | | | |
|---|---|---|---|---|
| 2017/0071444 | A1* | 3/2017 | Hofmann | A47L 15/4221 |
| 2019/0203843 | A1* | 7/2019 | Krieger | A47L 15/4472 |

FOREIGN PATENT DOCUMENTS

| | | | | | |
|---|---|---|---|---|---|
| CN | 203890745 | U | | 10/2014 | |
| CN | 111962265 | A | | 11/2020 | |
| CN | 216786564 | U | | 6/2022 | |
| CN | 216786565 | U | | 6/2022 | |
| GB | 928299 | A | * | 6/1963 | F16K 11/074 |
| JP | 2014090942 | A | | 5/2014 | |
| WO | 2015161607 | A1 | | 10/2015 | |

* cited by examiner

WASHING MACHINE CONTROL METHOD FOR DISPENSING LIQUID, AND WASHING MACHINE

FIELD

The application relates to a field of laundry treatment apparatus, and in particular relates to a washing machine control method for dispensing liquid and a washing machine.

BACKGROUND

With the development of science and technology, there are more and more types of laundry apparatus, and laundry apparatus becomes gradually more and more intellectualized. Automatic dispensing devices in the prior art have greatly facilitated people's lives. A variety of laundry treatment agents need to be separately dispensed by a feeding device with multiple delivery pumps. For a dispensing device, more delivery pumps are needed, the structure is complex, and the cost is high.

Chinese Patent Application No. CN201420198178.7 discloses a washing machine and an automatic dispensing system thereof. The automatic dispensing system includes a laundry treatment agent storage box with a plurality of laundry treatment agent storage chambers; an electromagnetic steering valve; and a delivery pump. The electromagnetic steering valve has a plurality of liquid inlets and one liquid outlet, the laundry treatment agent storage box is communicated with the electromagnetic steering valve, and the liquid inlets are connected with the laundry treatment agent storage chambers in one-to-one correspondent. The electromagnetic steering valve is used to selectively connect one of the liquid inlets with the one liquid outlet. The delivery pump has an inlet and an outlet, and the inlet of the delivery pump is connected with the one liquid outlet. The washing machine is controlled to connect the liquid outlet with one of the liquid inlets and disconnected from the other liquid inlets by the electromagnetic steering valve. Although the switching valve can be adjusted, the electromagnetic valve has low precision and cannot be continuously adjusted.

In view of this, the present application is proposed.

SUMMARY

The technical problem to be solved by the present application is how to overcome the deficiencies of the prior art. A control method for dispensing liquid and a washing machine are provided. In dispensing a laundry treatment agent, the valve core of the switching valve is first rotated to a preset neutral position wherein the valve core is not communicated with liquid inlets of the valve body. It is improved in accurately controlling the switching valve. After a laundry treatment agent is dispensed, the switching valve is again controlled to return to the preset neutral position, and then determining to receive a dispensing instruction. So the switching valve is continuously adjusted, and the practicality is increased.

Another aspect of the present application is to provide a washing machine. A washing machine can be continuously controlled and be improved in the control accuracy by controlling the state of the switching valve.

In order to solve the above-mentioned technical problems, the basic concept of the technical solution in the present application is to provide a washing machine control method for dispensing liquid. A switching valve includes a valve core and a valve body, the valve core is provided with one inlet and one outlet, and the valve body is provided with liquid inlets and one liquid outlet. One of the liquid inlets is as a water inlet.

The control method includes:

S1, receiving an instruction for dispensing laundry treatment agent;

S2, controlling the switching valve to be in a preset neutral position where the valve core is not communicated with the liquid inlets of the valve body;

S3, controlling the valve core of the switching valve to rotate to be communicated with a liquid inlet corresponding to a laundry treatment agent for dispensing;

S4, controlling the switching valve to rotate to be in the preset neutral position;

S5, determining whether to dispense a laundry treatment agent again; if yes, executing step S3; if not, controlling the switching valve to feed water for flushing.

In an operation of a washing machine in the present application, after receiving an instruction for dispensing a laundry treatment agent, the switching valve starts to run from the neutral state. It is avoided that the inlet of the valve core of the switching valve is in inaccurate communication with the liquid inlet of the valve body. After dispensing the corresponding laundry treatment agent, the switching valve is controlled to return to the preset neutral position again, and then determine whether to receive a dispensing instruction. So, the switching valve is continuously controlled, it is improved in accurately controlling the switching valve, and it is increased in user's experience.

As an embodiment, the switching valve includes a stepper motor. The stepper motor is connected with the valve core and is used to drive the valve core to rotate in the valve body. A limiting component is arranged at the preset neutral position, for preventing the valve core from continuing to rotate.

In step S2, the following steps are also included:

S21, controlling the switching valve to rotate toward a preset neutral position;

S22, detecting a current value I of the stepper motor;

S23, determining whether the current value I of the stepper motor is greater than or equal to a preset value I0; if yes, determining that the switching valve is rotated to the preset neutral position, and controlling the switching valve to stop rotating.

As an embodiment, a limiting rib is arranged at the preset neutral position of the valve body. An end of the valve core is provided with a positioning protrusion. The positioning protrusion is configured to be abutted against the limiting rib to limit a rotation range of the valve core.

In step S2, the following steps are also included:

S21, controlling the switching valve to rotate toward a preset neutral position;

S22, detecting a position of the positioning protrusion relative to the limiting rib;

S23, determining whether the positioning protrusion is in contact with the limiting rib; if yes, determining that the switching valve rotates to a preset neutral position, and controlling the switching valve to stop rotating.

Further, in step S3, the following steps are included:

S31, obtaining a rotation direction and calculating an amount of rotation steps according to the preset neutral position and a position of a liquid inlet corresponding to a laundry treatment agent;

S32, controlling the stepper motor to rotate according to the rotation direction obtained and the rotation steps calculated;

S33, dispensing the corresponding laundry treatment agent.

Further, between the step S3 and the step S4, the following steps are also included:

detecting a volume of flow L1 of a laundry treatment agent, and determining whether the volume of flow L1 of the laundry treatment agent is greater than or equal to a preset volume of flow L1; if yes, determining that a process of dispensing the laundry treatment agent is completed, and executing step S4.

As an embodiment, in step S5, the following steps are included:

obtaining whether a laundry treatment agent is dispensed again within a preset time T; if yes, executing step S3; if not, controlling to flush the switching valve with water.

Further, in S5, the preset time T is 1 s≤T≤5 s.

As an embodiment, the liquid inlets of the valve body include one water inlet, which is used to flush the switching valve with water.

In step S5, if it is determined that the switching valve is controlled to be flushed with water, the following steps are included:

S51, obtaining a rotation direction and calculating a amount of rotation steps according to a preset neutral position and a position of the water inlet;

S52, controlling the stepper motor to run according to the rotation direction obtained and the rotation steps calculated;

S53, controlling to flush the switching valve with water.

The present application also provides a washing machine, which adopts any one of the washing machine control method for dispensing liquid described above.

Through the above technical solution, the present application has the following advantages compared with the prior art.

(1) In the present application, when it is determined that a laundry treatment agent is dispensed by detecting a current value of the stepper motor, it is determined whether the switching valve is in the preset neutral position. It is avoided that an inlet of the valve core abnormally communicates with the liquid inlets of the valve body when the switching valve is in dispensing. So various laundry treatment agents can be dispensed, the control accuracy of the switching valve is improved, and the user's experience is increased.

(2) In the present application, a stepper motor is used for controlling the switching valve to realize the continuous adjustment of the neutral state, the dispensing state and the flushing state of the switching valve during operation. The stepper motor is controlled to run according to the rotation direction and an amount of rotation steps, so the inlet of the valve core is connected with or disconnected from the liquid inlets of the valve body to realize the change of the state of the switching valve. The switching valve can be highly accurately controlled, and the dispensing accuracy and the washing effect are improved.

The specific implementations of the present application are further described in detail below in conjunction with the accompanying drawings.

DESCRIPTION OF DRAWINGS

The drawings serve as a part of the present application to further understand the present application, and illustrative embodiments of the present application and the description thereof are used to explain the present application, but do not constitute an undue limitation on the present application. Apparently, the drawings in the following description are merely some embodiments, and those of ordinary skill in the art can obtain other drawings according to these drawings without creative work. In the figures.

Figure 1:
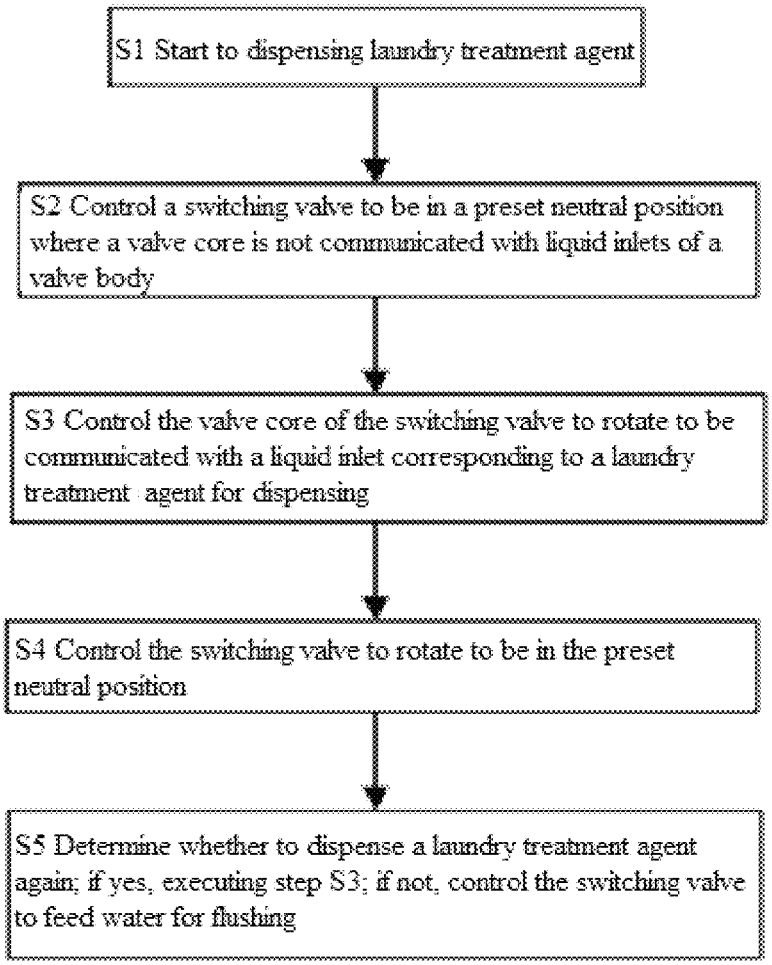
FIG. 1 is a flow chart of a method for controlling to dispense liquid into a washing machine according to the present application.
Figure 2:
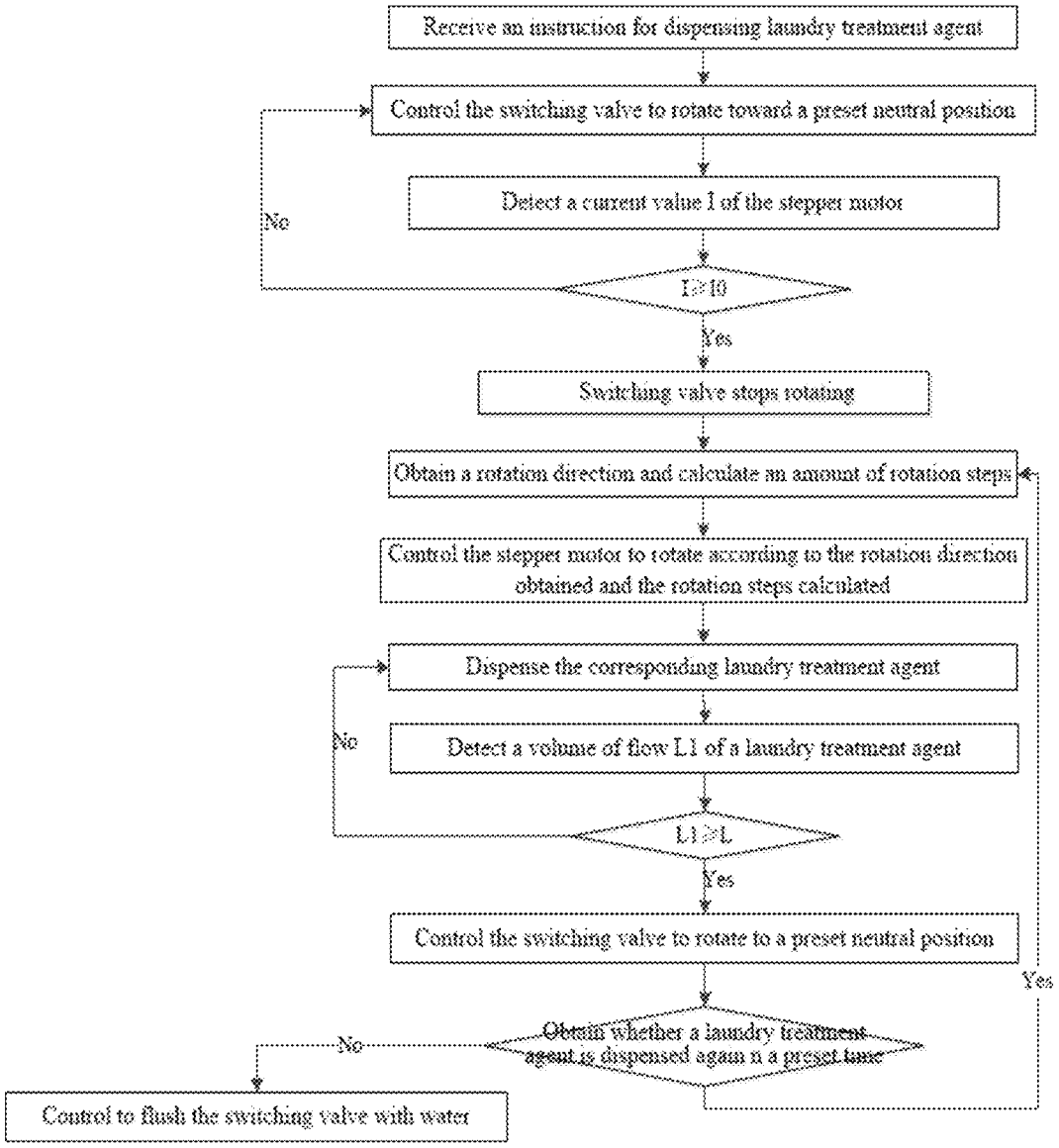
FIG. 2 is a flow chart of a method for controlling to dispense liquid into a washing machine according to the present application.
Figure 3:
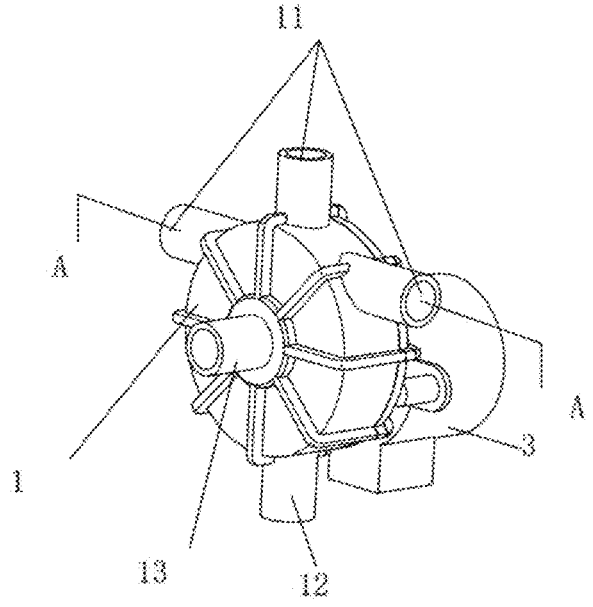
FIG. 3 is a structural diagram of a switching valve of the present application.
Figure 4:
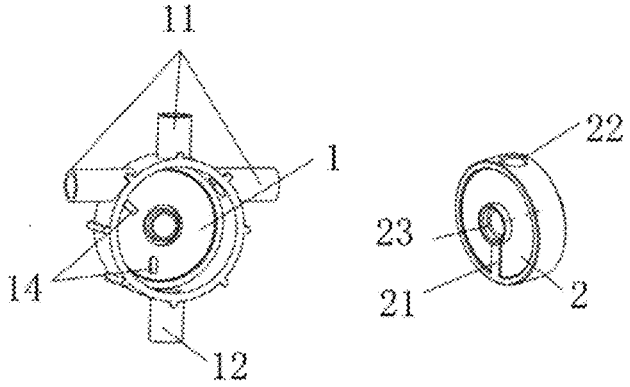
FIG. 4 is a structure diagram of a valve body and a valve core of a switching valve of the present application.

In the figures: 1, valve body; 11, liquid inlet; 12, water inlet; 13, liquid outlet; 14, limit rib; 2, valve core; 21, positioning protrusion; 22, inlet; 23, outlet; 3, stepper motor.

It should be noted that these drawings and text descriptions are not intended to limit the concept scope of the present application in any way, but illustrate the concept of the present application for those skilled in the art by referring to specific embodiments.

DETAILED DESCRIPTION

In order to make objects, technical solutions and advantages of the embodiments of the present application clearer, the solutions in the embodiments are clearly and completely described as follows in combination with accompanying drawings in the embodiments of the present application. The following embodiments are used for illustrating the present application, rather than limiting the scope of the present application.

In the description of the present application, it should be noted that, the orientation or positional relationship indicated by such terms as "up", "down", "front", "rear", "left", "right", "vertical", "inner" and "outer" is the orientation or positional relationship based on the accompanying drawings. Such terms are merely used for conveniently and simplified describing the present application, rather than indicating or implying that the device or element referred to must be located in a certain orientation or must be constructed or operated in a certain orientation. Therefore, the terms cannot be understood as a limitation to the present application.

In the description of the present application, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection or can be indirect connection through an intermediate. For those skilled in the art, specific meanings of the above terms in the present application can be understood according to specific conditions.

As shown in FIG. 1 to FIG. 7, a washing machine in a washing machine controlling method for dispensing liquid according to the present application includes a switching valve.

The switching valve includes a valve core 2 and a valve body 1.

The valve body 1 is provided with liquid inlets 11, and the valve core 2 is rotatably installed in the valve body 1 and can be selectively communicated with one of the liquid inlets 11.

The control method includes:

S1, receiving an instruction for dispensing laundry treatment agent;

S2, controlling the switching valve to be in a preset neutral position where the valve core 2 is not communicated with the liquid inlets 11 of the valve body 1;

S3, controlling the valve core 2 of the switching valve to rotate to be communicated with a liquid inlet corresponding to the laundry treatment agent for dispensing;

S4, controlling the switching valve to rotate to be in the preset neutral position;

S5, determining whether to dispense a laundry treatment agent again; if yes, executing step S3; if not, controlling the switching valve to feed water for flushing.

In an operation of a washing machine in the present application, after receiving an instruction for dispensing a laundry treatment agent, the switching valve is controlled to be in a preset neutral position, and then a laundry treatment agent is controlled to be dispensed in the instruction, so that it is avoided that an inlet 22 of the valve core 2 communicates abnormally with the liquid inlets 11 of the valve body 1 when the switching valve is in dispensing. After dispensing, the switching valve returns to be in the neutral position again, and then it is determined that whether to dispense a laundry treatment agent again. So an operation of dispensing again a laundry treatment agent or flushing the switching valve is completed, various laundry treatment agents are dispensed and are continuously controlled, and it is improved to control accurately the switching valve and increased in user's experience.

Further, a stepper motor 3 is also included.

The stepper motor 3 is connected with the valve core 2 and is used to drive the valve core 2 to rotate in the valve body 1.

A limiting component is arranged at the preset neutral position, for preventing the valve core 2 from continuing to rotate.

In step S2, the following steps include:

S21, controlling the switching valve to rotate toward a preset neutral position;

S22, detecting a current value I of the stepper motor 3;

S23, determining whether the current value I of the stepper motor 3 is greater than or equal to a preset value I0, if yes, determining that the switching valve is rotated to the neutral position where not to execute dispensing, and executing step S3.

In the present application, it is compared a current value I1 of the stepper motor 3 during operation with a preset current value I of the stepper motor 3. When the current value I1 of the stepper motor 3 is greater than or equal to the preset current value I, it is determined that the switching valve is in the preset neutral position, and the switching valve is controlled to perform dispensing by a washing machine.

Further, a limiting rib 14 is arranged at the preset neutral position of the valve body 1. An end of the valve core 2 is provided with a positioning protrusion 21. The positioning protrusion 21 is configured to be abutted against the limiting rib 14 to limit a rotation range of the valve core 2.

In step S2, the following steps include:

S21, controlling the switching valve to rotate toward the preset neutral position;

S22, detecting a position of the positioning protrusion 21 relative to the limiting rib 14;

S23, determining whether the positioning protrusion 21 is in contact with the limiting rib 14, if yes, determining that the switching valve rotates to a preset neutral position, and controlling the switching valve to stop rotating.

In the present application, the positioning protrusion 21 is provided on the valve core 2 and the limiting rib 14 is provided at the preset neutral position of the valve body 1. When it is determined that the switching valve needs to return to the neutral state, the stepper motor 3 is configured to drive the valve core 2 to rotate. When the positioning 21 of the valve core 2 abuts against the limiting rib 14 of the valve body 1, it is determined that the switching valve is in the preset neutral position.

Specifically, the positioning protrusion 21 is configured to abut against the limiting rib 14, the rotation of the valve core 2 driven by the stepper motor 3 is blocked, and the current value is increased. Therefore, it is determined the switching valve rotates to the preset neutral position by determining whether the current value I1 exceeds the preset current value I of the stepper motor 3.

When washing laundry next time, it is only necessary to detect whether the switching valve is be in the preset neutral position wherein the valve core 2 is not connected with the liquid inlets 11 of the valve body 1. When the switching valve is already in the preset neutral position, there is no need to control the switching valve to rotate again, and the switching valve is controlled to directly perform dispensing, so that it is reduced in the complexity of dispensing liquid for the next washing.

Figure 5:
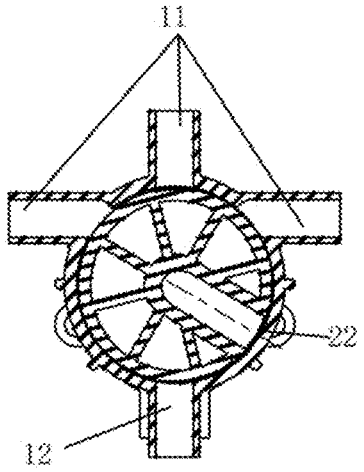
FIG. 5 is a schematic diagram of a switching valve in a preset neutral position of the present application.

As shown in FIG. 5, the switching valve is in a neutral state when the switching valve rotates to a preset neutral position where the valve core 2 is not in communication with the liquid inlets 11 of the valve body 1.

Further, in step S3, the following steps are included:

S31, obtaining a rotation direction and calculating an amount of rotation steps according to the preset neutral position and a position of a liquid inlet corresponding to a laundry treatment agent;

S32, controlling the stepper motor 3 to rotate according to the rotation direction obtained and the rotation steps calculated;

S33, dispensing the corresponding laundry treatment agent.

In the present application, it is first determined the state of the switching valve. The switching valve performs dispensing only when the state of the switch valve is in the neutral state. When performing dispensing, it is avoided that the laundry treatment agent is dispensed due to the connection of the inlet 22 and the liquid inlet before not returning to the neutral state, so as to prevent the laundry treatment agent from being wasted or overflowing the switching valve. The dispensing accuracy is improved.

Specifically, in the present application, the rotation direction is obtained and an amount of rotation steps is calculated according to the preset neutral position and the position of the liquid inlet corresponding to the laundry treatment agent. The stepper motor 3 is controlled to rotate according to the obtained rotation direction and the calculated rotation steps. After the switching valve is rotated according to the rotation direction and the amount of rotation steps, it is determined that the liquid inlet is connected with the inlet 22 of the valve core 2, and the corresponding detergent is dispensed. Thereby the switching valve is controlled to accurately dispense the laundry treatment agent, and it is increased in user's experience.

Figure 6:
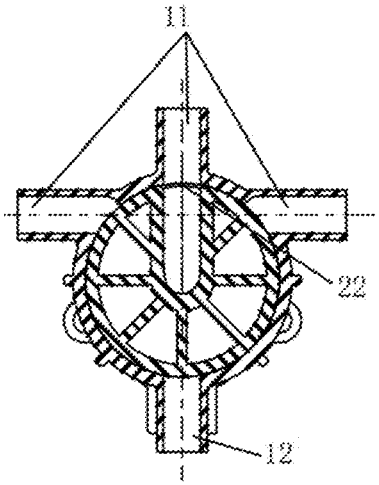
FIG. 6 is a schematic diagram of a switching valve of the present application in a dispensing state.

As shown in FIG. 6, a switching valve is in a dispensing state in which the valve core 2 of the switching valve is in communication with the liquid inlet corresponding to a laundry treatment agent, and the laundry treatment agent is dispensed.

Further, between step S3 and step S4, the following steps are also included: detecting a volume of flow L1 of a laundry treatment agent, and determining whether the volume of flow L1 of the laundry treatment agent is greater than or equal to a preset volume of flow L1; if yes, determining that a process of dispensing the laundry treatment agent is completed, and executing step S4; if not, determining that a process of dispensing the laundry treatment agent is not completed, and executing step S33.

The present application determines whether a process of dispensing the laundry treatment agent is completed according to the amount of flow L1 of the laundry treatment agent through the switch valve. If the amount of flow L1 is not greater than or not equal to the preset volume of flow L, it is determined that a process of dispensing the laundry treatment agent is not completed, and the laundry treatment agent continues to be dispensed. When the amount of flow L1 of the treatment agent is greater than or equal to the preset volume of flow L, it is determined that a process of dispensing the laundry treatment agent is completed. Thereby it is improved in the accuracy of dispensing the laundry treatment agent and increased in the washing effect of laundry.

It can also be determined that a process of dispensing a laundry treatment agent is completed by comparing time t1 of dispensing a laundry treatment agent with a set time t. Within a set time range T, a laundry treatment agent in the switching valve can better flow into a washing barrel. A laundry treatment agent is prevented from remaining in the switching valve and from blocking the switching valve to reduce the washing effect.

In step S4, the following steps are included:

S41, controlling the switching valve to rotate toward a preset neutral position;

S42, detecting a current value I of a stepper motor 3;

S43, determining whether the current value I of the stepper motor is greater than or equal to a preset value I0, if yes, determining that the switching valve rotates to a preset neutral position, and controlling the switching valve to stop rotating.

By controlling the switching valve to return to the neutral state again after a process of dispensing the laundry treatment agent is completed. It is convenient for a washing machine to obtain a rotation direction of the stepper motor 3 and calculate an amount of rotation steps. Thereby it is improved to accurately control the valve core 2 to rotate by the stepper motor 3, and the inlet 22 of the valve core 2 is ensured to be communicated more accurately with the liquid inlets 11 and a water inlet 12 of the valve body 1. The accuracy dispense of the switching valve is improved and user's experience is increased.

Further, in step S5, the following step is included:

obtaining whether a laundry treatment agent is dispensed again within a preset time T; if yes, executing step S3; if not, controlling to flush the switching valve with water.

Further, in step S5, the preset time T is 1 s≤T≤5 s.

Optionally, the preset time T is 3 s.

Specifically, after a laundry treatment agent is dispensed into a washing machine for a first time and when a laundry treatment agent needs to be dispensed again within the preset time T, a dispensing process is same as the above-mentioned dispensing process. According to a preset neutral position and a position of a liquid inlet corresponding to a laundry treatment agent, the rotation direction is obtained and an amount of rotation steps is calculated. The stepper motor 3 is configured to control the inlet 22 of the valve core 2 to be communicated with a liquid inlet corresponding to the laundry treatment agent according to the obtained rotation direction and the calculated rotation steps, and the switching valve is in the dispensing state again.

Further, the liquid inlets 11 of the valve body 1 include one water inlet 12 for flushing the switching valve with water.

In step S5, if it is determined that the switching valve is controlled to be flushed with water, the following steps are included:

S51, obtaining a rotation direction and calculating a amount of rotation steps according to a preset neutral position and a position of the water inlet 12;

S52, controlling the stepper motor 3 to run according to the rotation direction obtained and the rotation steps calculated;

S53, controlling to flush the switching valve with water.

In the present application, the switching valve is switched to a dispensing state from a neutral state, and returns to the neutral state after a dispensing process is completed. When the washing machine controls the switching valve to be flushed, a rotation direction is obtained and an amount of rotation steps is calculated according to the preset neutral position and the position of the water inlet 12 of the valve body 1, and the stepper motor 3 is controlled to run according to the obtained rotation direction and the calculated number of rotation steps. It is determined that the water inlet 12 is connected with the inlet 22 of the valve core 2, and the switching valve is controlled to be flushed with water. Thereby, the laundry treatment agent is prevented from remaining in the switching valve to cause the switching valve to be blocked and reduce the dispensing efficiency and washing effect. It is improved in the dispensing accuracy of the laundry treatment agent, and three states of the switching valve can be continuously controlled.

Figure 7:
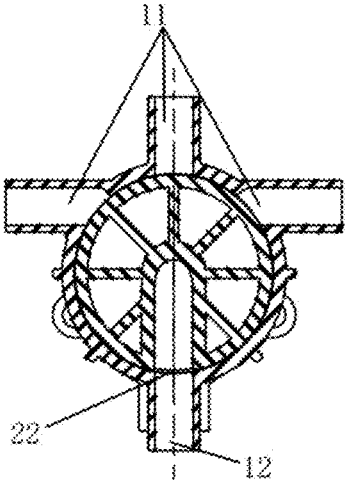
FIG. 7 is a schematic diagram of a switching valve of the present application in a flushing state.

As shown in FIG. 7, a flushing state of the switching valve refers to a process of controlling the switching valve to be flushed with water.

When the switching valve is controlled to be flushed with water, it is determined that a process of flushing the switching valve is completed and the operation is ended by comparing a flushing time T1 with a set flushing time T2. The switching valve is prevented from flushing for a long-term to waste water resources.

Specifically, a waterway is provided in a washing machine to be connected with the water inlet 12 of the switching valve, and the residual laundry treatment agent in the passage is flushed with tap water. The stepper motor controls an opening of the valve core 2 to be communicated with the water inlet 12 of the valve body for flushing the switching valve. The switching valve is switched from the dispensing state to the flushing state, and a process of flushing the switching valve is completed.

In the present application, if a laundry treatment agent needs to be dispensed for several times in a dispensing process or after flushing with water, the stepper motor 3 is configured to drive the switching valve to return to the neutral state after each dispensing process of the switching valve is completed. It is facilitated that a washing machine controls the stepper motor 3 to rotate and calculate an amount of rotation steps, the controlling method is simple, and a laundry treatment agent is accurately dispensed.

In the neutral state, the dispensing state and the flushing state of the switching valve, pipelines are connected through forward or reverse rotation of the stepper motor 3 in the corresponding direction and the amount of rotation steps.

The present application can also use electrical signals or magnetic switches to control the switching valve.

Specifically, the valve core 2 is provided with a permanent magnet, and the liquid inlets of the valve body 1 are provided with different magnetic induction switches. When the stepper motor 3 is configured to control the valve core 2 to rotate to a corresponding position, the magnetic induction generates an electric signal, so as to obtain the operating state of the switching valve and dispense the laundry treatment agent.

In a controlling method for dispensing liquid for a washing machine according to the present application, when the switching valve is working, an operation of returning an initial position is performed, that is, the initial position is in a neutral state. It is determined to be in the neutral state in which the limiting rib 14 of the valve body 1 is in contact with the positioning protrusion 21 on the valve core 2, and the stepper motor 3 is blocked. At this time, the current of the motor is greater than the preset current value, which means that the switching valve is in the neutral state.

Starting from the neutral state, the stepper motor 3 rotates in the corresponding direction or an amount of rotation steps according to the signals of the system to control the valve core 2 to be communicated with the liquid inlets 11 or the water inlet 12 of the valve body 1, to e continuously control three states of the switching valve including the neutral state, the dispensing state and the flushing state. It is improved in accurately controlling the switching valve and accurately dispensing a laundry treatment agent, and the washing effect and user's experience are increased.

The present application also provides a washing machine, which adopts any one of the controlling methods for dispensing liquid into a washing machine described above.

The embodiments merely describe preferred embodiments of the present application, rather than limiting the concept and scope of the present application. The preferred embodiments are disclosed above, and not used for limiting the present application. Under the premise of not departing from the idea of the present application, various changes and improvements made to the technical solution of the present application by those skilled in the art, such as simple amendment, equal change and modify according concept of the present application, shall all fall within the protection scope of the present application. The solutions in the above embodiments can be further combined or substituted.

What is claimed is:

1. A washing machine control method for dispensing liquid, including,

S1, receiving an instruction for dispensing laundry treatment agent;

S2, controlling a switching valve to be in a preset neutral position where a valve core is not communicated with liquid inlets of a valve body;

S3, controlling the valve core of the switching valve to rotate to be communicated with a one of the liquid inlets corresponding to a laundry treatment agent for dispensing;

S4, controlling the switching valve to rotate to be in the preset neutral position;

S5, determining whether to dispense a laundry treatment agent again; if yes, executing step S3; if not, controlling the switching valve to feed water for flushing, wherein, the washing machine includes the switching valve;

the switching valve includes the valve core and the valve body, the valve body is provided with the liquid inlets, the valve core is rotatably installed in the valve body and is configured to be selectively communicated with one of the liquid inlets.

2. The washing machine control method for dispensing liquid according to claim 1, wherein, the switching valve includes a stepper motor, the stepper motor is connected with the valve core and is used to drive the valve core to rotate in the valve body, and a limiting component is arranged at the preset neutral position for preventing the valve core from continuing to rotate; wherein, step S2 includes:

S21, controlling the switching valve to rotate toward the preset neutral position;

S22, detecting a current value I of the stepper motor;

S23, determining whether the current value I of the stepper motor is greater than or equal to a preset value I0; if yes, determining that the switching valve is rotated to the preset neutral position, and controlling the switching valve to stop rotating.

3. The washing machine control method for dispensing liquid according to claim 1, wherein, a limiting rib is arranged at the preset neutral position of the valve body, an end of the valve core is provided with a positioning protrusion, and the positioning protrusion is configured to be abutted against the limiting rib to limit a rotation range of the valve core; wherein, step S2 includes:

S21, controlling the switching valve to rotate toward the preset neutral position;

S22, detecting a position of the positioning protrusion relative to the limiting rib;

S23, determining whether the positioning protrusion is in contact with the limiting rib; if yes, determining that the switching valve rotates to the preset neutral position, and controlling the switching valve to stop rotating.

4. The washing machine control method for dispensing liquid according to claim 1, wherein, step S3 includes:

S31, obtaining a rotation direction and calculating an amount of rotation steps according to the preset neutral position and a position of one of the liquid inlets corresponding to a laundry treatment agent;

S32, controlling the stepper motor to rotate according to the rotation direction and the rotation steps;

S33, dispensing the laundry treatment agent.

5. The washing machine control method for dispensing liquid according to claim 1, between step S3 and step S4, including:

detecting a volume of flow L1 of a laundry treatment agent, and determining whether the volume of flow L1 of the laundry treatment agent is greater than or equal to a preset volume of flow L1; if yes, determining that a process of dispensing the laundry treatment agent is completed, and executing step S4.

6. The washing machine control method for dispensing liquid according to claim 1, wherein, in step S5 includes:

obtaining whether a laundry treatment agent is dispensed again within a preset time T; if yes, executing step S3; if not, controlling to flush the switching valve with water.

7. The washing machine control method for dispensing liquid according to claim 6, wherein, in step S5, the preset time T is in a range of $1s \leq T \leq 5s$.

8. The washing machine control method for dispensing liquid according to claim 6, wherein, the liquid inlets of the valve body include one water inlet for flushing the switching valve with water;

in step S5, if it is determined that the switching valve is controlled to be flushed with water, the following steps are included:

S51, obtaining a rotation direction and calculating a amount of rotation steps according to the preset neutral position and a position of the water inlet;

S52, controlling the stepper motor to run according to the rotation direction and the rotation steps;

S53, controlling to flush the switching valve with water.

9. The washing machine control method for dispensing liquid according to claim 6, wherein, in step S5, the preset time T is 3s.

* * * * *